United States Patent [19]

Tanaka et al.

[11] Patent Number: 4,886,719

[45] Date of Patent: Dec. 12, 1989

[54] ELECTROPHOTOGRAPHY PHOTOSENSITIVE MEMBER AND A METHOD FOR FABRICATING SAME

[75] Inventors: Eiichiro Tanaka; Akio Takimoto; Koji Akiyama; Kyoko Onomichi; Masanori Watanabe; Chisato Sakahara, all of Osaka, Japan

[73] Assignee: Matsushita Electric Industrial Co., Ltd., Osaka, Japan

[21] Appl. No.: 190,093

[22] Filed: May 4, 1988

[30] Foreign Application Priority Data

May 7, 1987 [JP] Japan ..... 62-111002
Jun. 25, 1987 [JP] Japan ..... 62-158221
Jul. 1, 1987 [JP] Japan ..... 62-164556

[51] Int. Cl.[4] ..... G03G 5/10
[52] U.S. Cl. ..... 430/58; 430/66
[58] Field of Search ..... 430/58, 57, 69, 66

[56] References Cited

U.S. PATENT DOCUMENTS 4,462,929 7/1984 Shacklette et al. ..... 524/401

FOREIGN PATENT DOCUMENTS 54-143645 11/1979 Japan .
55-90954 7/1980 Japan .
60-59353 4/1985 Japan .

*Primary Examiner*—John L. Goodrow
*Attorney, Agent, or Firm*—Lowe, Price, Leblanc, Becker & Shur

[57] ABSTRACT

Disclosed is an electrophotography photosensitive member (10) and a method for fabricating the same. This electrophotography photosensitive member (10) comprises a straight chain compound polymer including (i) as main component, a straight chain compound polymer having p-phenylene in the direction of a main chain, and an element of Group VIB at a para-position, the element of Group VIB being selected from the group consisting of S, Se, Te and mixtures thereof; and (ii) oxygen atom. Since oxygen atom is included in the straight chain compound polymer, desirable characteristics are obtained. This photosensitive member (10) is produced at a low cost with a high productivity, thereby providing a high sensitivity, an excellent printing durability and a long lifetime.

21 Claims, 2 Drawing Sheets

FIG. 4-a
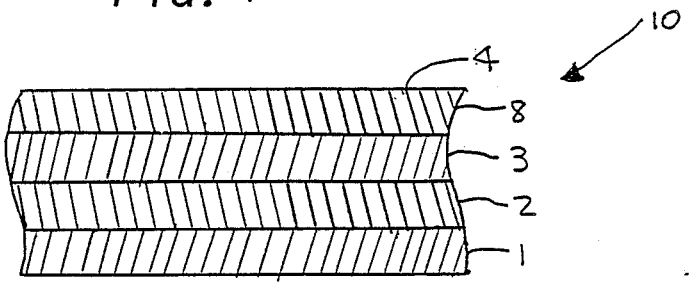
FIG. 4-b
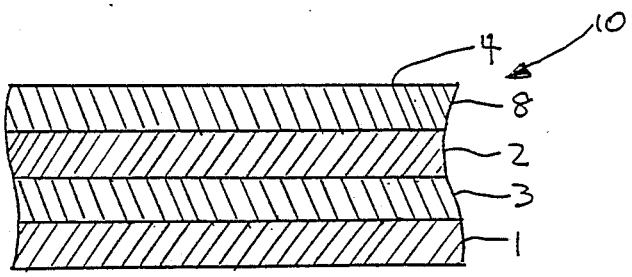
FIG. 4-c
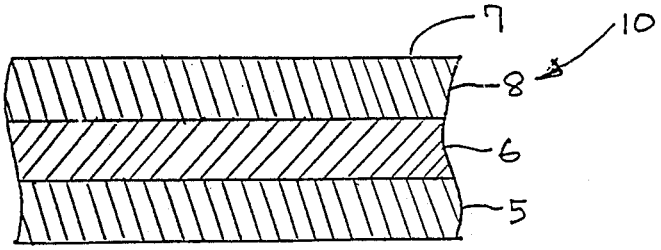

ELECTROPHOTOGRAPHY PHOTOSENSITIVE MEMBER AND A METHOD FOR FABRICATING SAME

BACKGROUND OF THE INVENTION

This invention relates to an electrophotography photosensitive member used for a copying machine of an electrophotographic type, a photo printer or the like, and a method for fabricating the same.

Conventionally, in an electrophotography photosensitive member, the function-separated type of the electrophotography photosensitive member is widely used which comprises different material layers. One such layer is a carrier transport layer for transporting carrier and the other is a carrier generation layer for generating carrier due to optical pumping. By selecting the material depending on the function of the material, an excellent photosensitive member having a high sensitive electrophotography property can be provided. Moreover, the most suitable combination of materials can be investigated using various materials having different properties such as mechanical strength, thermal stability, printing durability and manufacturing cost.

Organic materials have become of major interest and are actively investigated because there are various kinds of organic materials.

There are many electrophotography photosensitive materials comprising a carrier transport layer and a carrier generation layer which utilize organic materials. For example, there are combinations of methyl squaric acid and triaryl pyrazoline, combinations of dyanblue and oxadiazole, combinations of perylene pigment and oxadiazole, combinations of bis-azo pigment and styrian anthracene, and the like.

Besides, combinations, inorganic materials are also used as the carrier generation layer. For example, there are the combination of amorphous silicon as the carrier generation layer and organic semiconductor material as carrier transport layer which is disclosed in Japanese Laid-open Patent Application No.54-143645, and the combination of amorphous selenium and polyvinylcarbazole. These combinations belong to the function-separated type of photosensitive materials.

In the function-separated type of photosensitive materials comprising combinations of organic materials, there are many problems such as the printing durability is poor, the lifetime is short, and the reliability is poor.

In such photosensitive members using organic materials, the carrier generation layer, the carrier transport layer, and moreover, a surface layer for increasing the hardness of the surface or the like are formed on a sheet-like substrate of an endless belt or the like, or on a cylindrical drum made by a cutting method or a molding method such as an impact method. In this case, it is necessary to uniformly each form of the layers in accordance with the process necessary for producing the electrophotography.

The methods by which each of such layers is formed, include a dip coating method, a spray coating method by a spray gun, and an US-spray coating method using ultrasonic waves. However, these methods require large plant and equipment investment.

In the combination of the inorganic materials as the carrier generation layer and the organic materials as the carrier transport layer, attempts to use an inorganic carrier generation layer having a large degree of hardness as the surface layer, in order to improve the printing durability. However, in order to maintain the desired properties, many carrier generation layers having an excellent printing durability require heating of the substrate or require a process such as the method using plasma by which the surface is heated to a high temperature. In such cases, since the organic carrier transport layer has an inferior heat resistance, a photosensitive member having desired properties cannot be obtained.

Of such methods described above, Japanese Laid-open patent application No. 55-90954 and Japanese Laid-open patent application No. 60-59353 discloses that PPS (poly-p-phenylene sulfide) film used as the carrier transport layer is an excellent material which can be cheaply produced, and deposited as a polymer film having a high carrier mobility.

It is necessary for the electrophotography photosensitive member to have a small dielectric constant, a large mobility, a large carrier lifetime, and a capacity for generating large amounts of carrier in order to have a high sensitivity. Therefore, in the function-separated type of the photosensitive member, it is desirable to combine a carrier transport layer having the large mobility and the large carrier lifetime and a carrier generation layer having the capacity for generating large amounts of carrier. However, it is necessary to include a carrier injection between both layers, even if each of the layers satisfies the required conditions stated above. Moreover, it is necessary that the properties such as abrasion resistance, a capacity for accepting carrier, and the like, which are required to the process of the electrophotography, be present.

Japanese Laid-open patent application No. 55-90954 discloses PPS is formed into thin film. The capacity of the PPS for transporting carrier of PPS is improved by the method of vacuum deposition, by which method the resulting film is applied to the carrier transport layer. However, the resulting carrier transport layer has a small capacity for transporting carrier, and does not have a sufficient sensitivity and a good residual electric potential. Moreover, the time required for making the film is long because of the vacuum deposition method. Therefore, the resulting photosensitive member is of high cost among the photosensitive members using organic materials. Furthermore, the resulting film does not have sufficient hardness nor sufficient printing durability.

Japanese Laid-open patent application No. 55-90954 discloses a photosensitive member that can be cheaply produced by applying the PPS film to the carrier transport layer. However, the photosensitivity does not reach the level of practical use of the electrophotography photosensitive member, because of the insufficient capacity for transporting carrier.

Moreover, the function-separated type of the photosensitive member using organic materials has a problems associated with miniaturizing the electrophotography apparatus because this photosensitive member requires negative charging. Furthermore this photosensitive member has a problem because it generates ozone.

SUMMARY OF THE INVENTION

The present invention has been developed in order to overcome the above-mentioned drawbacks inherent to the conventional electrophotography photosensitive member.

It is, therefore, an object of the present invention to provide an electrophotography photosensitive member which is cheap, is produced with a high productivity, and obviates the need for a coating apparatus.

Another object of the present invention is to provide a high performance photosensitive member which has a high sensitivity, an excellent printing durability, and a long lifetime.

The other object of the present invention is to provide an electrophotography photosensitive member which can be used in the range of charging positively, has a high sensitivity and a low residual electric potential, and is inexpensive.

In accordance with the present invention there is further provided an electrophotography photosensitive member comprising: a straight chain compound polymer including (i) as main component, a straight chain compound polymer having p-phenylene in the direction of a main chain, and element of Group VIB at the para-position, the element of Group VIB being one of S, Se and Te; and (ii) oxygen atom.

In accordance with the present invention there is provided an electrophotography photosensitive member comprising: (a) a carrier generation layer for generating carrier by optical pumping; and (b) a carrier transport layer for transporting the carrier including (i) a straight chain compound polymer having p-phenylene, and element of Group VIB at the para-position, the element of VIb group being one of S, Se and Te, and (ii) oxygen atom, the carrier generation layer and the carrier transport layer being piled.

BRIEF DESCRIPTION OF THE DRAWINGS

The object and features of the present invention will become more readily apparent from the following detail description of the preferred embodiments taken in conjunction with the accompanying drawings in which:

FIG. 4-*a*, 4-*b* and 4-*c* are cross-sectional views of electrophotography photosensitive members according to a fourth embodiment of this invention.

DETAILED DESCRIPTION OF THE INVENTION

Figure 1:
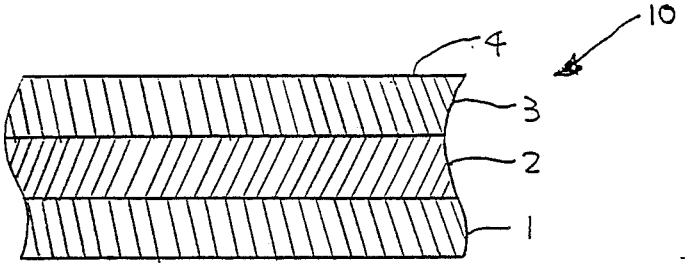
FIG. 1 is a cross-sectional view of an electrophotography photosensitive member according to a first embodiment of this invention.

FIG. 1 shows an embodiment of an electrophotography photosensitive member according to the present invention. As shown in FIG. 1, the electrophotography photosensitive member 10 comprises a substrate 1, a carrier transport layer 2, and a carrier generation layer 3. The carrier generation layer 3 has a free surface 7 at one side. Various metals such as aluminum are mainly used as the substrate 1. The carrier transport layer 2 comprises a polymer layer whose main component is a straight chain compound having a p-phenylene, and having chalcogen element at para position such as PPS (poly-p-phenylene sulfide). The carrier transport layer 2 is treated under conditions of a temperature between 250° and 350° C. and a time between 0.2 to 50 hours, and more preferably, a temperature between 260° and 290° C. and a time between 1 and 12 hours, in an atmosphere containing oxygen. In order to prevent the PPS film from having a low carrier mobility and a short lifetime, various investigation have been carried out. As a result of these investigations, it was discovered that the capacity for transporting carrier can be largely improved by the treatment described above. Moreover, it was confirmed that the capacity for transporting carrier is not improved in an atmosphere of innert gas such as nitrogen or in a vacuum. Furthermore, it is confirmed that 1 to 35% by atom, and more preferably 1 to 20% by atom of oxygen atom is included in the treated carrier transport layer 2.

The treated carrier transport layer 2 must satisfy the properties described above such as the capacity for accepting carrier, abrasion resistance, high photosensitivity, low residual electric potential, and the like, which are required in electrophotography processes. The carrier transport layer 2 is hardened by the treatment described above, whereas the hardness of PPS film formed by a biaxial stretching method is so very soft that the hardness of the film cannot be exactly measured by a Micro Vickers hardness tester, when the treatment is not carried out. On the other hand, the Vickers hardness of the film treated as described above is 10 to 80. Owing to the fact that the heat resistance is increased and oxygen atom which increases the capacity for transporting carrier is stably incorporated into the film, a electrophotography photosensitive member 10 having a high sensitivity and a low residual electric potential can be produced. Moreover, the electrophotography photosensitive member 10 has a stability even when the film is made by a plasma or when the substrate 1 is heated so as to form the carrier generation layer 3 having a high capacity for generating carrier.

As a result, a photosensitive member 10 having an excellent printing durability can be obtained without reducing the hardness of the entire photosensitive member, even when the carrier generation layer 3 which has a high capacity for generating carrier and has Vickers hardness of 100 or more is thinly formed on the PPS layer 2.

Typical inorganic material used as the carrier generation layer 3 includes non-single crystal layer containing silicon having a large hardness. Single layer or a piling layer containing amorphous or non-single crystalline of a-Si (:H:X:), a-$Si_{l-y}C_y$ (:H:X) (0(y(1), a-$Si_{1-y}O$ (:H:X) (0(y(1), a-$Si_{1-y}N_y$ (:H:X) (0(y(1), a-$Si_{1-z}Ge_z$ (:H:X) (0(z(1), a-$(Si_{1-z}Ge_z)_{1-y}N_y$ (:H:X) (0(y,z(1), a-$(Si_{1-z}Ge_z)_{1-y}O_y$ (:H:X) (0(y, z(1) or a-$(Si_{1-z}Ge_z)_{1-y}C_y$ (:H:X) (0(y, z(1) are used as the carrier generation layer. In this case, these materials can be used even when "y" is successively varied.

a-Si (:H:X) used as the carrier generation layer 3 containing silicon can be prepared by a plasma CVD method, using gas containing silicon such as $SiH_4$, $Si_2H_6$, $Si_3H_8$, $SiF_4$, $SiCl_4$, $SiHF_3$, $SiH_2F_2$, $SiH_3F$, $SiHCl_3$, $SiH_2Cl_2$, $SiH_3Cl$ and the like. Moreover, a-Si (:H:X) can be prepared by a reactive sputtering method in which polycrystal silicon is used as a target in a mixture gas of Ar and $H_2$. In this case, the mixture gas can be mixed with $F_2$ or $H_2$.

a-$Si_{1-y}C_y$ (:H:X) (0(y(1), a-$Si_{1-y}O_y$ (:H:X) (0(y(1) or a-$Si_{l-y}N_y$ (:H:X) (0(y(1) can be prepared by a plasma sputtering method, using a gaseous hydrocarbon such as $CH_4$, $C_2H_6$, $C_3H_8$, $C_4H_{10}$, $C_2H_4$, $C_3H_6$, $C_4H_8$, $C_2H_2$, $C_3H_4$, $C_4H_6$ and the like; an allyl halide gas such as $CH_3F$, $CH_3Cl$, $CH_3I$, $C_2H_5Cl$, $C_2H_5Br$ and the like; a freon gas such as $CClF_3$, $CF_4$, $CHF_3$, $C_2F_6$, $C_3F_8$, and the like and; a gaseous fluorinated benzene such as $C_6H_{6-m}F_m$ (m=1 to 6) as a C source and the gas containing Si atom described above. These material can also be prepared by a reactive a sputtering method using a gas containing C atom described above, a sputtering gas such as Ar, and a silicon target described above. In this case, $O_2$, CO, $CO_2$, NO and $NO_2$ can be used as O source, and $N_2$, $NH_3$ and NO can be used as O source as well.

a-$Si_{1-z}Ge_z$(:H:X) (0(z(1) can be prepared by a plasma CVD method, using the gas containing Si atom described above and a gas containing Ge atom such as $GeH_4$, $Ge_2H_6$, $Ge_3H_8$, $GeF_4$, $GeCl_4$, $GeHF_3$, $GeH_2F_2$, $GeH_3F$, $GeHCl_3$, $GeH_2Cl_2$ and the like.

a-$(Si_{1-z}Ge_z)_{1-y}N_y$ (:H:X) (0(y, z(1), a-$(Si_{1-z}Ge_z)_{1-y}O_y$ (:H:X) (o(y, z(1) or a-$(Si_{1-z}Ge_z)_{1-y}$ (:H:X) (0(y, z(1) can be prepared by a plasma CVD method, using the gas containing Ge atom described above, and a-$Si_{1-y}C_y$ (:H:X) (0(y(1), a-$Si_{1-y}O_y$ (:H:X) (0(y(1) or a-$Si_{1-y}N_y$ (:H:X) (0(y(1) respectively.

Conductivity can be controlled by adding impurities to the film of a-Si (:H:X), a-$Si_{1-y}C_y$ (:H:X) (0(y(1), a-$Si_{1-y}O_y$ (:H:X) (0(y(1), a-$Si_{1-y}N_y$ (:H:X) (0(y(1) or Ge-added these materials. As a result, desirable electrophotography properties can be obtained. As P-type impurities which afford P-type conductivity, include elements of Group IIIB such as B, Al, Ga, In and the like. Preferably, B, Al and Ga are used. N-type impurities which afford N-type conductivity, include elements of Group of VB such as N, P, As, Sb and the like. Preferably, P and As are used.

As a method for adding these impurities, in the case of P-type materials, a gas such as $B_2H_6$, $B_4H_{10}$, $B_5H_{11}$, $B_6H_{12}$, $B_6H_{14}$, $BF_3$, $BCl_3$, $BBr_3$, $AlCl_3$, $(CH_3)_3Al$, $(i\text{-}C_4H_9)_3Al$, $(CH_3)_3Ga$, $(C_2H_5)_3Ga$, $InCl_3$ or such a gas diluted by $H_2$, He or Ar is mixed with a gas containing C atom as described above and a gas containing Si atom and the like as described above and the film is formed by a plasma CVD method. In the case of N-type materials, a gas such as $N_2$, $NH_3$, NO, $N_2O$, $NO_2$, $PH_3$, $P_2H_4$, $PH_4I$, $PF_3$, $PF_5$, $PCl_3$, $PCl_5$, $PBr_3$, $PBr_5$, $PI_3$, $AsH_3$, $AsF_3$, $ASCl_3$, $AsBr_3$, $SbH_3$, $SbF_3$, $SbF_5$, $SbCl_3$, $SbCl_5$ or such as a gas diluted by $H_2$, He or Ar is mixed with a gas containing C atom as described above and a gas containing Si atom and the like as described above and the film is formed by a plasma CVD method. In the reactive sputtering method, the gases are mixed with a mixed gas of Ar and $H_2$ (the mixed gas may contain $F_2$ or $Cl_2$). These gases are treated by conventional methods.

These carrier generation layers 3 have a large degree of hardness, and have Vickers hardness of 900 to 1200 when measured by a micro Vickers hardness tester.

Amorphous layers such as $As_2Se_3$ and the like containing chalcogen elements can be used as the inorganic carrier generation layer 3. The hardness of $As_2Se_3$ varies depending on substrate heating temperature during deposition. The Vickers hardness is 100 to 120 when the substrate temperature is 60° to 120° C. AsSeTe can also be used as the carrier generation layer 3 as a single layer or a piling layer thereof so as to afford a high sensitivity in the range of visible radiation or near infrared radiation. A layer of crystal powder CdS or CdSe bonded with resins can be also used. It is difficult to measure the hardness of the layer when the crystal having a capacity for transporting carrier containing chalcogen elements is bonded with resins. However, the hardness of the resulting layer described above is greater than the hardness of $As_2Se_3$ film. On the other hand, the hardness of the straight chain compound polymer layer is measured and used for ascertaining the progress of the heat treatment. In this case, micro Vickers hardness tester is used, and the measurement is carried out using an indenter of diamond having a load of 10 g.

On the other hand, typical organic materials such as nonmetal phthalocyanine ($H_2Pc$), metal phthalocyanine such as Cu-phthalocyanine (CuPu) or Mg-phthalocyanine (MgPc), halogenated metal phthalocyanine such as Indium phthalocyanine (InClPc), Aluminum phthalocyanine (AlClPc) or AlClPcCl, or TiOPc can be used as the carrier generation layer. These materials are formed into the carrier generation layer 3 by means of deposition and the like.

The thickness of the carrier transport layer 2 is 5 to 50 micrometers, and preferably, 10 to 25 micrometers. The thickness of the carrier generation layer 3 is 0.05 to 10 micrometers, and preferably, 0.1 to 5 micrometers.

Figure 2:
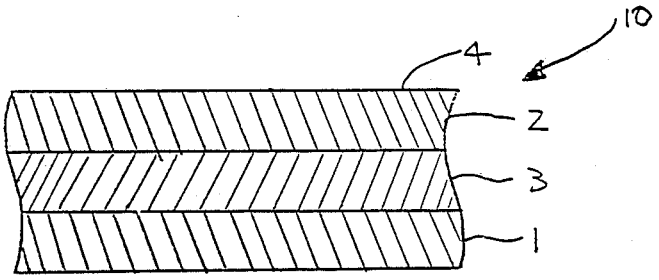
FIG. 2 is a cross-sectional view of an electrophotography photosensitive member according to a second embodiment of this invention.

FIG. 2 shows a second embodiment of the present invention for the electrophotography photosensitive member 10. As shown in FIG. 2, the electrophotography photosensitive member 10 comprises a substrate 1, a carrier transport layer 2, and a carrier generation layer 3. This second embodiment is different from the first embodiment in that the carrier generation layer 3 is directly disposed on the substrate 1. Therefore, the carrier transport layer 2 has a free surface 4 at one side thereof.

The method of formating each of these layers is the same as that of first embodiment. The effect of this embodiment is substantially equal to that of first embodiment. A barrier layer (not shown) can be provided between substrate 1 and carrier transport layer 2 in the first embodiment to prevent carrier from being injected from the substrate 1 to the carrier transport layer 2, and in order to improve the electrophotography property. A similar barrier layer can be provided between substrate 1 and carrier generation layer 3, in the second embodiment to prevent carrier from being injected from substrate 1 to carrier generation layer 3.

A similar barrier layer may be incorporated into the third embodiment which will be described below.

The barrier layer, may be made from a metallic oxide such as $Al_2O_3$, BaO, $BaO_2$, BeO, $Bi_2O_3$, CaO, $CeO_2$, $Ce_2O_3$, $La_2O_3$, $Dy_2O_3$, $Lu_2O_3$, $Cr_2O_3$, CuO, $Cu_2O$, FeO, PbO, MgO, SrO, $Ta_2O_3$, $ThO_2$, $ZrO_2$, $HfO_2$, $TiO_2$, TiO, $SiO_2$, $GeO_2$, SiO, or GeO, a metallic nitride such as TiN, AlN, SnN, NbN, TaN or GaN, a metallic carbide such as WC, SnC or TiC, an insulating material such as SiC, SiN, GeC, GeN, BC or BN, or an organic compound having heat resistance such as polyimide, poly-amide-imide or polyacrylonitrile.

Figure 3:
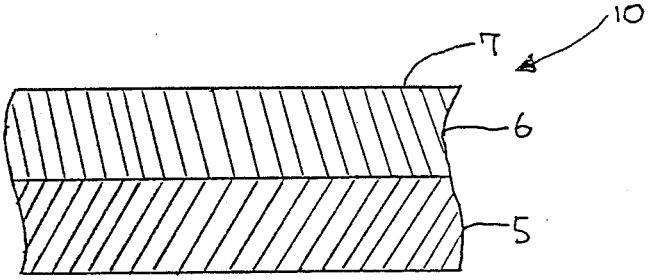
FIG. 3 is a cross-sectional view of an electrophotography photosensitive member according to a third embodiment of this invention.

FIG. 3 shows a third embodiment of the present invention for the electrophotography photosensitive member 10. As shown in FIG. 3, a photoconductive layer 6 comprising a polymer such as PPS including pigment or inorganic carrier generation material such as CdS is provided on a substrate 5. The photoconductive layer 6 has a free surface 7 at one side thereof. Inorganic carrier generation materials such as CdS, or organic pigments, which serve as carrier generation materials, such as phthalocyanine having heat resistance is dispersed in a film such as PPS. By thermally bonding the film containing carrier generation material on the substrate 1, the photosensitive member 10 can be inexpensively produced.

Pigments are mixed with the film such as PPS, phthalocyanine materials when preparing the photoconductive layer 6. Such pigments, include nonmetal phthalocyanine (H2Pc), metal phthalocyanine such as Cu-phthalocyanine (CuPc) or Mg-phthalocyanine (MgPc), halogenated metal phthalocyanine such as Indium phthalocyanine (InClPc), Aluminum phthalocyanine (AlClPc) and AlClPcCl, or TiOPc. Moreover, inorganic carrier generation materials are mixed with the film such as PPS, include CdS, CdSe and the like. When the photoconductive layer 6 is a single layer, the thickness of the film is 5 to 50 micrometers, and preferably, 10 to 25 micrometers.

A surface covering layer 8 can be formed as shown in FIG. 4-*a*, 4-*b* and 4-*c*, so as to increase a cleaning property, abrasion resistance or corona resistance. Materials used as such surface covering layer, include $Si_xO_{1-x}$, $Si_xC_{1-x}$, $Si_xN_{1-x}$, $Ge_xO_{1-x}$, $Ge_xC_{1-x}$, $Ge_xN_{1-x}$, $B_xN_{1-x}$, $B_xC_{1-x}$, $Al_xN_{1-x}$ (0(x(1), carbon, or such materials containing $H_2$ or a halogen. Moreover, organic compounds, include polyimide, poly-amide-imide, polyacrylonitrile and the like.

EXAMPLE 1

In this example, an electrophotography photosensitive member 10 of the type as shown in FIG. 1 is produced.

PPS films having thickness of 12, 25 and 50 micrometers were placed respectively on quartz glass base. Next, stainless steel bases coated with Teflon as mold lubricants were are placed on these films so as to apply pressure thereto. Thereafter, these films were treated under conditions of a temperature of 280° C. and a time of 1 hour in an atmosphere of oxygen so that these films became thermally bonded on the quarz glass bases. The hardness of these films was measured by a micro Vickers hardness tester. The hardness of the film having a thickness of 12 micrometers was 25±5. The hardness of the film having a thickness of 25 micrometers was 15±5. The hardness of the film having a thickness of 50 micrometer was 7±2.

Under these conditions, as shown in FIG. 1, PPS were thermally bonded on the aluminum substrate 1 so as to make the carrier transport layer 2. Next, the carrier generation layer 3 comprising $As_2Se_3$ and having a thickness of about 0.8 micrometer was formed by a vacuum deposition method, with the substrate 1 being heated to 140° C. As a result, the electrophotography photosensitive member 10 of this example was obtained.

Thereafter, the electrophotography photosensitive member 10, in which the thickness of PPS is 12 micrometer, was charged so that the surface potential of the photosensitive member 10 becomes +600V. When the photosensitive member 10 was exposed to the light of 500 nm, half value potential exposure was 0.5 lux.sec in the unit of illuminance. This value indicates extremely high sensitivity. Moreover, the residual potential is 90 or below. This value means excellent property.

During a similar test, the electrophotography photosensitive member 10, in which the thickeness of PPS is 25 micrometers, had a high half value potential exposure of 0.71 lux.sec. However, the residual potential was slightly high at 120 to 150V. The electrophotography photosensitive member 10, in which the thickness of PPS is 50 micrometer, had an extremely high residual potential at 400 to 450V so that this photosensitive member cannot be used practically.

EXAMPLE 2

In this example, an electrophotography photosensitive member 10 of the type as shown in FIG. 4-*a* was produced.

PPS having a thickness of 15 micrometer was thermally bonded with the aluminum substrate 1. In this way, two samples were are produced. One sample was treated under conditions of a temperature of 280° C. and a time of 6 hours in an atmosphere of oxygen. The other sample was treated under conditions of a temperature of 320° C. and a time of 6 hours in an atmosphere of oxygen.

The hardness of the PPS film 2 by the former treatment was 75±5. The PPS film 2 by the latter treatment was partially cracked, and the hardness of the PPS film 2 was 85±5.

After the former substrate 1 having the carrier transport layer 2 was placed at an anode side of a plane parallel plate type capacity coupling method plasma CVD appatatus having a discharge electrode of 6 inch, the air pressure within the chamber was reduced to $5\times10^{-6}$ torr or below, and the substrate 1 was heated to a temperature between 150° and 200° C. The carrier generation layer 3 comprising a-Si:H was formed with 10 to 40 sccm of $SiH_4$ and 10 ppm of $B_2H_6$ being introduced into the chamber under conditions of a pressure of 0.2 to 1.0 torr and a high frequency electric power of 20 to 100 W. Moreover, a surface covering layer 8 having a thickness of 0.08 to 0.3 micrometers and comprising Sil-xCx:H (0(x(1) was formed with 10 to 30 sccm of $SiH_4$ and 20 to 40 sccm of $C_2H_4$ being introduced into the chamber under conditions of a pressure of 0.2 to 1.0 torr and a high frequency electric power of 50 to 150 W. Thus, the electrophotography photosensitive member 10 was made.

The resulting photosensitive member 10 had an increased resistance against plasma. The photosensitive member 10 was charged so that the surface potential was 500 V and was exposed to white light. As a result, the photosensitive member 10 had a high sensitivity of 0.7 lux.sec and a residual potential of 100 V. This test proves that the photosensitive member 10 can be practically used.

The latter substrate 1 having the carrier transport layer 2 was treated in the same manner as the former described above. The resulting photosensitive member 10, had an increased number of cracks and the film peeling was partially risen.

In the case wherein 0.02 to 0.1 wt % of TCNE (tetra cyano ethylene) was added to the PPS layer 2 as a carrier accepting material, a electrophotography photosensitive member 10 was produced which had a smaller residual potential such as 50 to 90 V.

EXAMPLE 3

In this example, an electrophotography photosensitive member 10 of the type as shown in FIG. 1 was produced.

A cylindrical PPS film having a thickness of 15 micrometers was prepared by an inflation method. The drawing magnification was 3 to 4 in the direction of the axis of the cylinder and was 2 to 2.5 in the direction perpendicular to the axis of the cylinder. The diameter of the cylindrical film was 92 mm.

In the process of making the electrophotography photosensitive member 10, an aluminum drum having a diameter of 92 mm was inserted into the above mentioned cylindrical film, and the PPS film carrier transport layer 2 was formed by thermal contraction on the drum substrate 1. A thermal treatment was carried out in an atmosphere containing TCNQ (7, 7, 8, 8-tetra cyano quino di methane) as an electron acceptor. The resulting film was treated under conditions of a temperature of 265° C. and a time of 6 hours in an atmosphere of oxygen.

Similarly, a film for measuring hardness was treated as described above. The hardness of the resulting film was measured with the film being bonded with a quarz base. The hardness of the film was 25±4.

The drum described above was immersed in a solution containing CdS which is a carrier generation powder and polyurethane resin as a binding resin. CdS and the binding resin were in the ratio 100:20 by weight. A carrier generation layer 3 having a thickness of 5 micrometers was formed with the immersed drum and dried under conditions of a temperature of 170° C. and a time of 30 min.

Therefore the photosensitive drum obtained as described above was charged so that the surface potential became +600 V and the drum was exposed with white light. As a result, photosensitive drum was obtained whose half value potential exposure had a high photosensitivity at 2.3 lux.sec and a residual potential sufficiently small at 90 V or below. The electrophotography photosensitive member 10 obtained as described above had a long lifetime, a capability for printing eighty thousand sheets or more and was inexpensive.

EXAMPLE 4

In this example, an electrophotography photosensitive member 10 of the type as shown in FIG. 3 or 4-*c* was produced. A cylindrical PPS film containing 0.05 to 20 wt % of $H_2Pc$ and having a thickness of 20 micrometers or below was placed on an aluminum drum substrater 5, which substrate had a polished surface. The diameter of the cylindrical PPS film was slightly smaller than that of the drum.

The drum substrate 5 was cooled in a dry atmosphere so that the outer diameter of the drum became smaller by thermal contraction. Next, the cooled drum was inserted into the above-mentioned PPS film. Thereafter, the temperature of the drum was raised to room temperature so that the drum substrate 5 was placed in contact with the film. As a result, drum shaped substrate 5 was covered with the film having an uniform thickness as well.

The resulting drum substrate 5 was treated under conditions of a temperature between 260° and 280° C. and a time of 0.5 to 10 hours in an atmosphere of oxygen so as to carry out thermal bonding and thermal treatment. Thus, a photoconductive layer 6 was produced.

A single layer typed photosensitive member 10 comprising the photoconductive layer 6 as shown in FIG. 3 was dischaged so that the potential became +900 V. When the photosensitive member 10 was exposed with white light, the half value potential exposure was 3.0 lux.sec. or below. This value indicates a good photosensitivity.

In the case in which a surface covering layer 8 comprising polyimide and having a thickness of 0.2 micrometers was formed on the single layered photosensitive member 10 as shown in FIG. 4-*c*, the change of the surface potential was small, even when the photosensitive member 10 was used repeatedly. Thus, the resulting photosensitive member 10 had a good property.

EXAMPLE 5

In this example, an electrophotography photosensitive member 10 of the type as shown in FIG. 2 is produced.

A barrier layer (not shown) comprising $Ge_xN_{1-x}$ and having a thickness of 0.5 micrometers was formed on an aluminum drum substrate 1, which substrate had a polished surface. On the barrier layer, the carrier generation layer 3 comprising a-Si:H and having a thickness of 1 micrometer was formed. The resulting substrate 1 having the barrier layer and the carrier generation layer 3 was inserted into a cylindrical PPS film having a thickness of 25 micrometers or below whose diameter was slightly larger than that of the drum. The entire assembly was heated to a temperature between 100° to 150° C. During this testing the PPS film was thermally contracted so that PPS film was placed in contact with the carrier generation layer 3. Thereafter, the resulting entire was heated to a temperature between 250° and 290° C. in an atmosphere of oxygen so that the carrier transport layer 2 was formed.

This drum photosensitive member 10 was negatively charged so that the surface potential became −500 to −800 V. Then, a clear image was obtained. The half value potential exposure of this drum was 1 lux.sec. this value indicates a high photosensitivity. And the residual potential was −100 to −200 V.

When a-$(Si_{1-z}Ge_z)$:H in which Ge was added to a-Si:H was used, the photosensitivity became still higher. At the 2, 5 positions or the 3, 4 positions of the phenylene group, even when $H_2$ was replaced by different substituents the property did not change significantly.

EXAMPLE 6

In this example, an electrophotography photosensitive member 10 of the type as shown in FIG. 1 was produced.

PPS films having a thickness of 16 micrometers whose drawing magnification were changed were placed respectively on quartz glass bases. Next, stainless steel bases coated with Teflon as mold lubricant were placed on these films as weights so that the uniformity of these films is improved. PPS films were thermally bonded with the quarz bases under conditions of a temperature of 280° C. and a time of 1 hour in an atmosphere of oxygen. The hardness of these films was measured by a micro Vickers hardness tester. The hardness of the film was 35±5 when the drawing magnification was 4.0. The hardness of the film was 15±5 when the drawing magnification was 1.5 to 2.0. The hardness of the film is 7±2 when the drawing magnification was 1.2 to 1.5.

Under these conditions described above, PPS films were thermally bonded with aluminum substrates 1 respectively so as to form the carrier transport layers 2. Next, the carrier generation layers 3 comprising Se and having a thickness of about 0.8 micrometers were formed by a vacuum deposition method. Thus, electrophotography photosensitive members 10 were produced.

The electrophotography photosensitive member 10 whose carrier transport layer 2 comprised PPS having 4.0 to 6.0 of the drawing magnification was charged so that the surface potential became +600 V. When the photosensitive member 10 was exposed with 500 nm of light, the half value potential exposure was 1.3 lux.sec.

in the unit of illuminance. This value indicates extremely high photosensitivity. Moreover, the residual potential was 60 V or below. This value indicates an excellent property.

The electrophotography photosensitive member 10 whose carrier transport layer 2 comprised PPS having 1.5 to 2.0 of the drawing magnification was evaluated in the same manner as described above. As a result, although the half value potential exposure was as high as 1.5 lux.sec, a relatively high residual potential of 120 V was resulted.

The electrophotography photosensitive member 10 whose carrier transport layer 2 comprised PPS having 1.2 to 1.5 of the drawing magnification had 300 to 350 V or more of the residual potential so that this photosensitive member 10 cannot be practically used.

Moreover, in the film having 7.0 or more of the drawing magnification, cracks were partially raised so that this film cannot be practically used.

The above-described embodiments are merely examples of the present invention, and therefore, it will be apparent for those skilled in the art that many modifications and variations may be made without departing from the scope of the present invention.

What is claimed is:

1. A charge transport layer for use in an electrophotography photosensitive member comprising:

a straight chain compound polymer layer including (i) as main component, a straight chain compound polymer having p-phenylene in the direction of a main chain, and an element of Group VIB at a para-position, said element of Group VIB being selected from the group consisting of S, Se, Te and mixtures thereof; and (ii) oxygen atom, said straight chain compound polymer layer having been subjected to a thermal treatment process in a oxygen containing atmosphere so as to improve the hardness thereof.

2. A charge transport layer for use in an electrophotography photosensitive member as claimed in claim 1, wherein said element of Group VIB is S.

3. A charge transport layer for use in an electrophotography photosensitive member as claimed in claim 1, wherein said straight chain compound polymer includes 1 to 35% by atom of exygen atoms.

4. A charge transport layer for use in an electrophotography photosensitive member as claimed in claim 1, further comprising an electron acceptor added to said straight chain compound polymer.

5. A charge transport layer for use in an electrophotography photosensitive member as claimed in claim 1, wherein said straight chain compound polymer layer has a Vicker hardness of 10 to 80.

6. A charge transport layer for use in an electrophotography photosensitive member as claimed in claim 1, further comprising a surface covering layer.

7. A charge transport layer for use in an electrophotography photosensitive member as claimed in claimed 1, wherein the temperature of said thermal treatment process is 250° to 350° C.

8. A charge transport layer for use in an electrophotography photosensitive member as claimed in claim 1, wherein said straight chain compound polymer is first produced in the form of a film by a biaxial stretching method so as to have a drawing magnification of 1.5 to 6.0 in at least one direction, then formed on a substrate surface and thermally treated.

9. A charge transport layer for use in an electrophotography photosensitive member as claimed in claim 8, wherein said film has a drawing magnification of 5 to 50 in at least one direction and a cylindrical shape, and is heated and placed in contact with a surface of a drum substrate by thermal contraction.

10. An electrophotography photosensitive member comprising:

(a) a carrier generation layer for generating carriers in response to the incident light; and (b) a carrier transport layer for transporting said carriers including (i) a straight chain compound polymer having p-phenylene, and an element of Group VIB at a para-position, said element of Group VIB being selected from the group consisting of S, Se, Te and mixtures thereof, and (ii) oxygen atom, said straight chain compound and polymer having been subjected to a thermal treatment process in an oxygen containing atmosphere to improve the hardness thereof, said carrier generation layer and said carrier transport layer forming a layered structure.

11. An electrophotography photosensitive member as claimed in claim 10 wherein said element of Group VB is S.

12. An electrophotography photosensitive member as claimed in claim 10, wherein said straight chain compound polymer includes from 1 to 35% by atom of oxygen atoms.

13. An electrophotography photosensitive member as claimed in claim 10, further comprising an electron acceptor added to said straight chain compound polymer layer.

14. An electrophotography photosensitive member as claimed in claim 10, wherein said straight chain compound polymer layer has a Vickers hardness of 10 to 80.

15. An electrophotography photosensitive member as claimed in claim 10 further comprising a surface covering layer.

16. An electrophotography photosensitive member as claimed in claim 10, wherein said carrier generation layer comprises a non-single crystal layer including a modification material for decreasing electron spin density and a member selected from the group consisting of S, Ge and mixtures thereof.

17. An electrophotography photosensitive member as claimed in claim 10, wherein said carrier generation layer is superimposed on said carrier transport layer and said carrier generation layer has a Vickers hardness of at least 100 at room temperature.

18. An electrophotography photosensitive member as claimed in claim 12, wherein said carrier generation layer comprises a non-single crystal layer comprising a chalcogen element.

19. An electrophotography photosensitive member as claimed in claim 10, wherein the temperature of said thermal treatment process is 250° to 350° C.

20. An electrophotography photosensitive member as claimed in claim 10, wherein, said straight chain compound polymer is first produced in the form of a film by a biaxial stretching method so as to have a drawing magnification of 1.5 to 6.0 in at least one direction, then formed on a substrate surface and thermally treated.

21. An electrophotography photosensitive member as claimed in claim 20, wherein said film has a drawing magnification of 1.5 to 6.0 in at least one direction and a cylindrical shape and is heated and placed in contact with a surface of a drum substrate by thermal contraction.

* * * * *